United States Patent [19]

Cusick, III

[11] 4,422,491

[45] Dec. 27, 1983

[54] COLLAPSIBLE AWNING FRAME

[76] Inventor: Joseph B. Cusick, III, P.O. Box 66, Peck, Kans. 67120

[21] Appl. No.: 282,008

[22] Filed: Jul. 10, 1981

[51] Int. Cl.[3] ..... E04F 10/04

[52] U.S. Cl. ..... 160/58 R; 160/65

[58] Field of Search ..... 160/58 RC, 54, 56, 57, 160/65, 74, 82

[56] References Cited

U.S. PATENT DOCUMENTS

| | | | |
|---|---|---|---|
| 317,485 | 5/1885 | Barlow | 160/58 |
| 363,155 | 5/1887 | Mason | 160/56 |
| 501,932 | 7/1893 | Glawe | 160/82 |
| 1,222,907 | 4/1917 | Truemper | 160/58 X |
| 1,285,804 | 11/1918 | Saylor | 160/65 X |
| 1,562,355 | 11/1925 | Manassa | 160/56 |
| 1,595,887 | 8/1926 | Spaulding | 160/65 |
| 2,642,133 | 6/1953 | Brody | 160/82 X |

*Primary Examiner*—Peter M. Caun
*Assistant Examiner*—Cherney S. Lieberman
*Attorney, Agent, or Firm*—Edwin H. Crabtree

[57] ABSTRACT

A collapsible awning frame for mounting in front of an opening in a window, door, or the like. The frame receiving an awning thereon. The frame is characterized by having a rigid structure which can withstand high winds. Also, the frame provides sufficient room to allow windows and doors to be opened outwardly for receiving outside air. Further, the frame and awning can be quickly folded adjacent the opening by loosening only a pair of lock screws.

8 Claims, 5 Drawing Figures

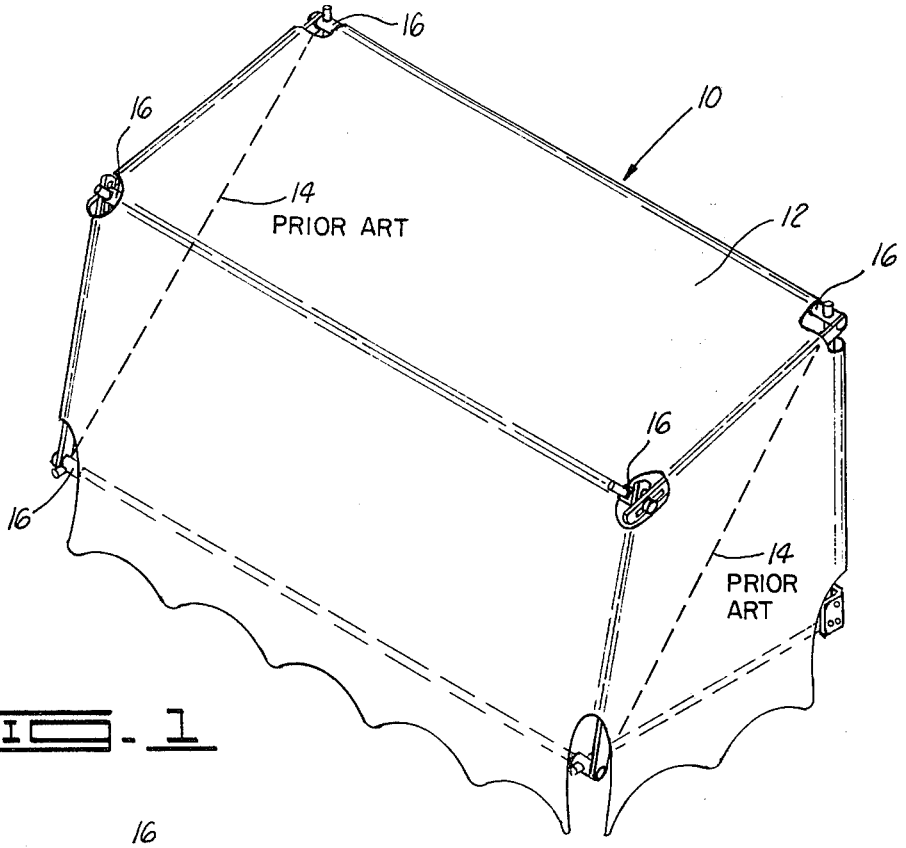
FIG. 1
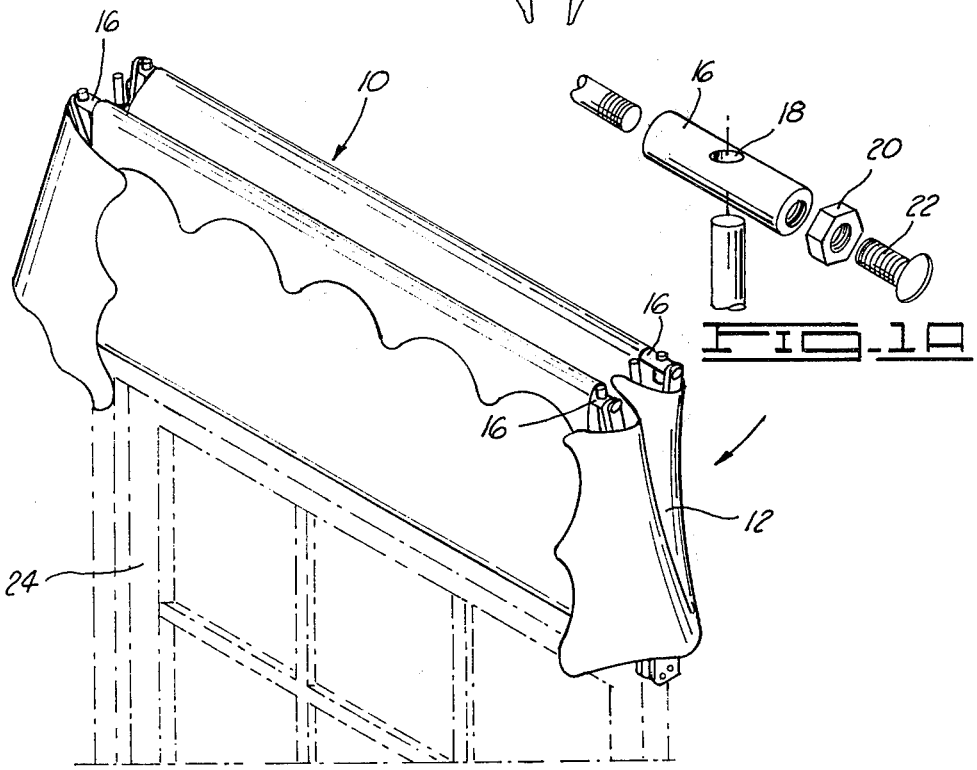
FIG. 1A
FIG. 2

COLLAPSIBLE AWNING FRAME

BACKGROUND OF THE INVENTION

This invention relates to an awning for mounting in front of a building opening and more particularly, but not by way of limitation to an improved awning frame for mounting in front of a window or door.

Heretofore, there have been various types of awning frames for receiving awning material such as canvas, lightweight metal, wood and other materials. Some of these awnings are adapted for folding adjacent the building, and are disclosed in the following U.S. patents:

U.S. Pat. No. 317,485 to Barlow

U.S. Pat. No. 501,932 to Glawe

U.S. Pat. No. 2,642,133 to Brody.

The awnings described in the above patents all slope downwardly at an angle of approximately 45° in front of the openings. This type of structure restricts the opening of a window or door when they are opened outwardly from the building. The subject invention eliminates the above mentioned problem along with additional advantages and features as described herein.

SUMMARY OF THE INVENTION

The subject collapsible awning frame with awning is unique in design, easy to install, and is adapted for quickly extending in front of a building opening or folding adjacent the opening when the awning is no longer required.

The improved awning frame with awning is rugged in design and can withstand winds up to and exceeding 50 mph. By loosening a pair of lock screws received in threaded connectors, the awning frame and awning can be quickly folded adjacent the opening in the building.

The structure of the awning frame is designed so that when the awning frame and awning are mounted in front of the opening sufficient room is provided to allow for windows or doors which open outwardly to the outside to be opened without being restricted by the awning frame.

The collapsible awning frame for mounting in front of an opening of a window, door or the like, includes a first and second hinge adapted for mounting on opposite sides of the opening. A first vertical and second vertical rod are attached to the two hinges and extend upwardly therefrom. The ends of the vertical rods are attached to a horizontal upper tie rod. A first and second fold rod are attached to the hinges and are attached to a horizontal lower tie rod. A first and second slide rod are attached to the hinges and are attached to a horizontal extension tie rod. A first and second upper slide arm are attached to the upper tie rod and the extension tie rod. A first and second lower slide arm are also attached to the extension tie rod with the other ends of the lower slide arms attached to the lower tie rods. By sliding the extension tie rod along the length of the slide rods, the upper slide arms and lower slide arms are folded inwardly along with the fold rods and lower tie rod, thereby retracting the awning frame and awning thereon inwardly adjacent the opening of the window or door.

The advantages and objects of the invention will become evident from the following detailed description of the drawings when read in connection with the accompanying drawings which illustrate preferred embodiments of the invention.

BRIEF DESCRIPTION OF THE DRAWINGS

FIG. 1 is a perspective view of the awning frame with the awning mounted thereon.

FIG. 1A is an enlarged view of a threaded connection used in securing the awning frame together.

FIG. 2 is a perspective view showing the awning frame and awning in a folded position adjacent a window.

DETAILED DESCRIPTION OF THE DRAWINGS

Figure 3:
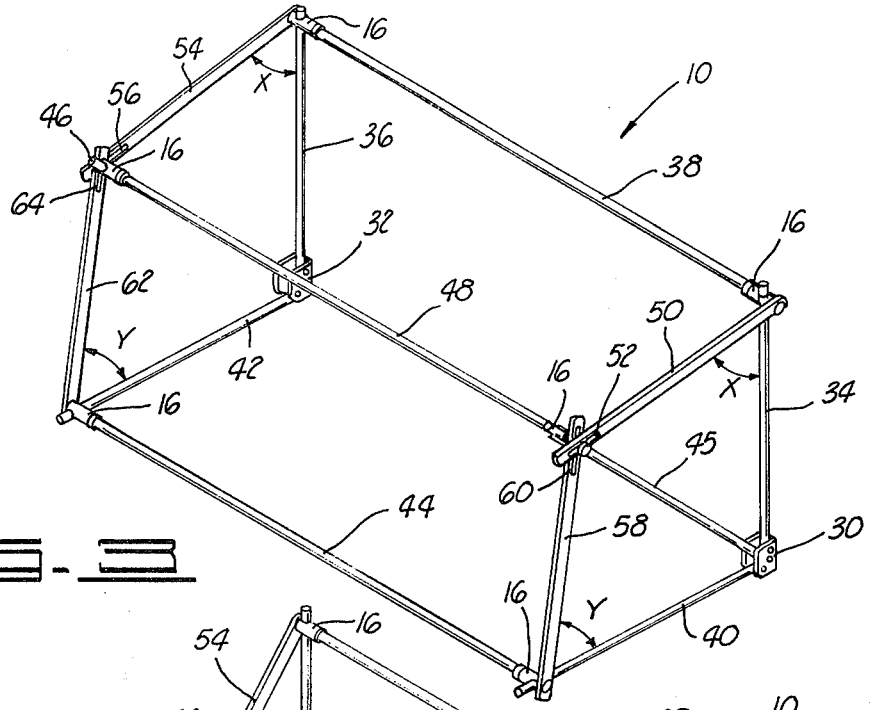
FIG. 3 is a perspective view of an awning frame with the awning removed and the awning frame shown in a fully extended position.

In FIG. 1 the improved awning frame is shown in dotted lines and designated by general reference numeral 10. The awning frame 10 is covered by an awning 12 made of a flexible canvas material, or any other similar material, used in making a high quality awning for mounting in front of a window or door. In FIG. 1 a pair of dotted lines 14 are shown to illustrate how the prior art awnings normally slope at an angle of approximately 45° from the vertical side of a building.

In FIG. 1A a threaded connector 16 having a slide hole 18 is shown for receiving one end of a rod therein. The connector 16 is used in joining the various members of the frame 10 and will be shown and discussed in the other drawings. The connector 16 further includes a lock nut 20 and a lock screw 22. By loosening the lock screw 22, the rod can be easily moved inside the slide hole 18. The opposite end of the connector 16 is threaded for receiving one end of a tie rod. The rod and tie rods are shown in greater detail and numbered in FIGS. 3, 4 and 5.

In FIG. 2, by loosening a pair of the threaded connectors 16, the frame 10 can be quickly folded adjacent to and above a window 24. While the window 24 is shown, it can be appreciated that the awning frame 10 can be easily adapted and mounted above a door opening or any other type of opening in a building structure. The window 24 can be a tilt-out window, swing-out window, or any other type.

In FIG. 3 the awning 12 has been removed to expose the unique structure of the subject awning frame 10. The awning frame 10 includes a first hinge 30 and a second hinge 32 adapted for mounting on opposite sides of the window or door. A first vertical rod 34 is attached to the hinge 30 and extends upwardly therefrom. A second vertical rod 36 is attached to the second hinge 32 and extends upwardly therefrom. The upper ends of the rods 34 and 36 are connected to a horizontal upper tie rod 38 by a pair of the threaded connectors 16.

A first fold rod 40 is pivotally attached to the first hinge 30 and in fully extended position is in a horizontal position. A second fold rod 42 is pivotally attached to the second hinge 32 and is also horizontal. The opposite ends of the first rod 40 and second rod 42 are connected to a lower tie rod 44 again by a pair of threaded connectors 16.

A first slide rod 45 is pivotally attached to the first hinge 30 and in an extended position is at an angle of approximately 45° from the first vertical rod 34. A second slide rod 46 is pivotally attached to the second hinge 32 and is also at an angle of 45°. The ends of the first and second slide rods 45 and 46 are attached to a horizontal extension tie rod 48 by a pair of threaded connectors 16.

A first upper slide arm 50 is pivotally attached to the upper tie rod 38 with the other end having an elongated opening 52 for slidable attachment to one end of the extension tie rod 48. A second upper slide rod 54 is pivotally attached to the upper tie rod 38 with the other end having an elongated opening 56 for slidable attachment to the tie rod 48.

A first lower slide arm 58 is pivotally attached to the lower tie rod 44 with the other end having an elongated opening 60 for slidable attachment to one end of the extension tie rod 48. A second lower slide arm 62 is pivotally attached to one end of the lower tie rod 44 with the other end having an elongated opening 64 for slidable attachment to the opposite end of the extension tie rod 48.

It should be noted that the upper slide arms 50 and 54 are at an angle of approximately 65° to 70° with the vertical rods 34 and 36. This angle is shown as X. Also the lower slide arms 58 and 62 are at an angle of approximately 65° to 70° with the horizontal fold rods 40 and 42. This angle is shown as Y. This structure provides sufficient room to allow for swinging windows and doors to be opened outwardly.

Figure 4:
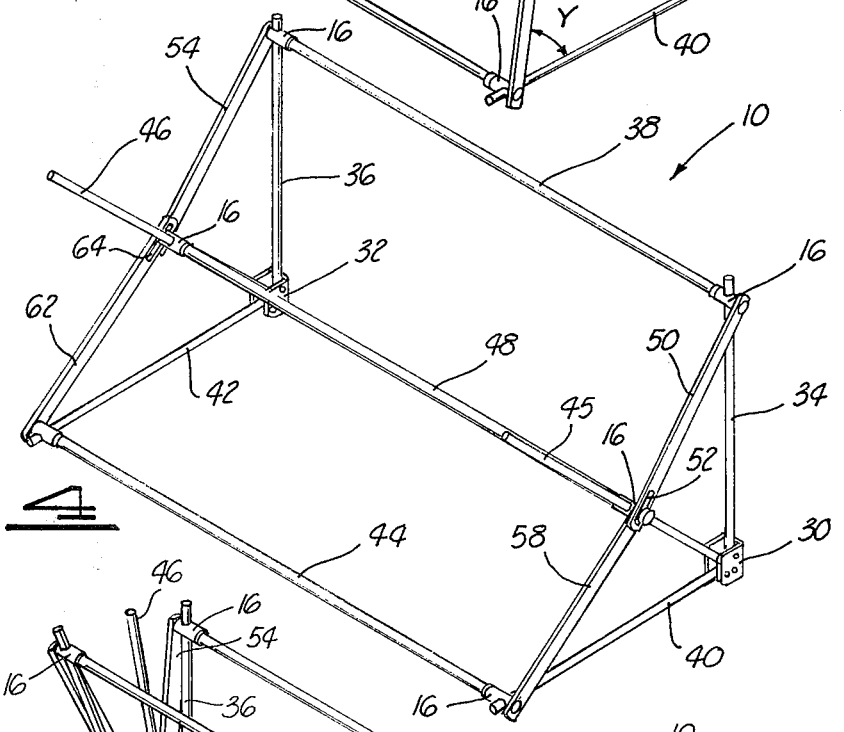
FIG. 4 illustrates the awning frame in a partially retracted position.

In FIG. 4 the improved awning frame 10 can be shown in a partially retracted position. By loosening the threaded connectors 16 attached to the opposite ends of the extension tie rod 48, the connectors 16 allow the extension rod 48 to slide along the length of the slide rods 45 and 46 inwardly toward the hinges 30 and 32. As the extension tie rod 48 slides inwardly, the upper slide arms 50 and 54 and lower slide arms 58 and 62 are folded inwardly with the ends of the extension tie rod 48 sliding in the openings 52 and 56 of the upper slide arms 50 and 54 and in the openings 60 and 64 of the lower slide arms 58 and 62.

Figure 5:
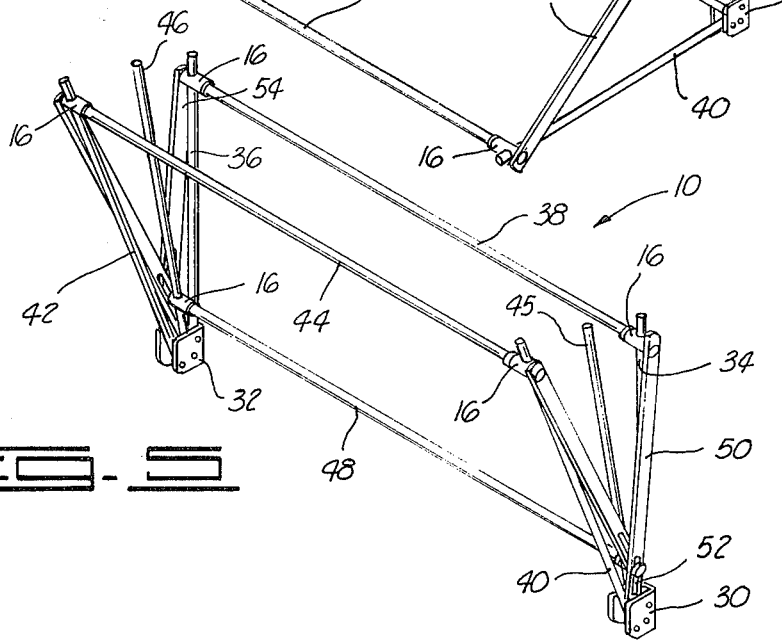
FIG. 5 illustrates the awning frame in a fully retracted position.

In FIG. 5 the awning frame 10 is shown in a completely retracted and folded position with the extension tie rod 48 in a lowered position adjacent the hinges 30 and 32. In this position the first fold rod 40 and second fold rod 42 have moved upwardly with the lower tie rod 44 parallel with the upper tie rod 38. Also, the ends of the upper slide arms 50 and 54 and lower slide arms 58 and 62 with the openings therein have been lowered to a position adjacent the hinges 30 and 32. In this position, the locking screw 22 of the two threaded connectors 16 attached to the extension rod 48 are again tightened to hold the arning frame 10 in a folded position as shown. It can be appreciated that by loosening the two locking screws 22, the awning frame 10 can then be extended outwardly to a fully extended position wth the screws again tightened and the awning 12 mounted thereon.

From the above description, it can be seen that through the use of the threaded connectors 16, hinges 30 and 32, tie rods 38, 44, 48, vertical rods 34 and 36, fold rods 40 and 42, slide rods 45 and 46 and upper slide arms 50 and 54 and lower slide arms 58 and 62, this structure can be quickly assembled for receiving the awning 12 thereon or quickly disassembled when the awning 12 is no longer required.

Changes may be made in the construction and arrangement of the parts or elements of the embodiments as disclosed herein without departing from the spirit or scope of the invention as defined in the following claims.

I claim:

1. A collapsible awning frame for mounting in front of the opening of a window, door, or the like, the frame comprising:

a first hinge and a second hinge adapted for mounting on the opposite sides of the opening;

a first vertical rod having a lower end attached to the first hinge and extending upwardly therefrom;

a second vertical rod having a lower end attached to the second hinge and extending upwardly therefrom;

a horizontal upper tie rod having opposite ends attached to the upper ends of the first and second vertical rods;

a first fold rod having one end attached to the first hinge;

a second fold rod having one end attached to the second hinge;

a horizontal lower tie rod having opposite ends attached to the other ends of the first and second fold rods;

a first slide rod having one end attached to the first hinge;

a second slide rod having one end attached to the second hinge;

a horizontal extension tie rod having opposite ends attached to the other ends of the first and second slide rods;

a first upper slide arm having one end attached to the upper tie rod and the other end attached to the extension tie rod;

a second upper slide arm having one end attached to the upper tie rod and the other end attached to the extension tie rod;

a first lower slide arm having one end attached to the extension tie rod and the other end attached to the lower tie rod; and a second lower slide arm having one end attached to the extension tie rod and the other end attached to the lower tie rod.

2. The frame as described in claim 1 wherein the frame when in a fully extended position outwardly from the opening, the first and second slide rods are held on the hinges at approximately 45° from the horizontal, the first and second fold rods held on the hinges in a horizontal position, the first and second upper slide arms held at an angle greater than 45° from the vertical rods, and the first and second lower slide arms held at an angle greater than 45° from the horizontal fold rods.

3. The frame as described in claim 1 wherein the frame when in a retracted position inwardly toward the opening, the ends of the extension tie rod slide inwardly along the length of the first and second slide rods with the ends of the first upper and lower slide arms and the ends of the second upper and lower slide arms folded inwardly.

4. The frame as described in claim 3 wherein the ends of the first upper and lower slide arms and the ends of the second upper and lower slide arms have an elongated opening therein for receiving the opposite ends of the extension tie rod therethrough, the ends of the extension tie rod sliding in the openings when the frame is extended or retracted in front of the opening.

5. The frame as described in claim 1 wherein the ends of the first and second slide rods are received through a slide hole in a threaded connector with lock screw, the connector attached to the ends of the extension tie rod, by loosening the lock screw the extension tie rod slides along the length of the slide rods.

6. The frame as described in claim 1 wherein the ends of the first and second vertical rods are received through a slide hole in a threaded connector with lock screw, the connector attached to the ends of the upper tie rod.

7. The frame as described in claim 1 wherein the ends of the first and second fold rods are received through a slide hole in a threaded connector with lock screw, the connector attached to the ends of the lower tie rod.

8. A collapsible awning frame for mounting in front of the opening of a window, door, or the like, the frame comprising:

a first hinge and a second hinge adapted for mounting on the opposite sides of the opening;

a first vertical rod having a lower end attached to the first hinge and extending upwardly therefrom;

a second vertical rod having a lower end attached to the second hinge and extending upwardly therefrom;

a horizontal upper tie rod having opposite ends attached to the upper ends of the first and second vertical rods;

a first fold rod having one end pivotally attached to the first hinge;

a second fold rod having one end pivotally attached to the second hinge;

a horizontal lower tie rod having opposite ends attached to the other ends of the first and second fold rods;

a first slide rod having one end pivotally attached to the first hinge;

a second slide rod having one end pivotally attached to the second hinge;

a horizontal extension tie rod having opposite ends slidably mounted on the other ends of the first and second slide rods;

a first upper slide arm having one end pivotally attached to the upper tie rod and the other end pivotally attached to the extension tie rod;

a second upper slide rod having one end pivotally attached to the upper tie rod and the other end pivotally attached to the extension tie rod;

a first lower slide arm having one end pivotally attached to the extension tie rod and the other end pivotally attached to the lower tie rod; and a second lower slide arm having one end pivotally attached to the extension tie rod and the other end pivotally attached to the lower tie rod.

* * * * *